US005803037A

United States Patent [19]

Kawamura et al.

[11] Patent Number: 5,803,037

[45] Date of Patent: Sep. 8, 1998

[54] JOINED TYPE VALVE SEAT

[75] Inventors: Osamu Kawamura; Teruo Takahashi; Arata Kakiuchi, all of Tochigi-ken, Japan

[73] Assignee: Nippon Piston Ring Co., Ltd., Tokyo-to, Japan

[21] Appl. No.: 869,845

[22] Filed: Jun. 5, 1997

[30] Foreign Application Priority Data

Jun. 7, 1996 [JP] Japan ..... 8-145368

[51] Int. Cl.[6] ..... F01L 3/04

[52] U.S. Cl. ..... 123/188.8; 251/360

[58] Field of Search ..... 123/188.3, 188.8; 251/360, 368

[56] References Cited

U.S. PATENT DOCUMENTS

| | | | |
|---|---|---|---|
| 4,422,875 | 12/1983 | Nakata et al. | 123/188.8 |
| 4,424,953 | 1/1984 | Takagi et al. | 123/188.8 |
| 4,546,737 | 10/1985 | Kazuoka et al. | 123/188.8 |
| 4,734,968 | 4/1988 | Kuroishi et al. | 123/188.8 |
| 4,933,008 | 6/1990 | Fujiki et al. | 123/188.8 |
| 5,031,878 | 7/1991 | Ishikawa et al. | 123/188.8 |
| 5,611,306 | 3/1997 | Takano | 123/188.8 |

FOREIGN PATENT DOCUMENTS

| | | | |
|---|---|---|---|
| 59-25959 | 2/1984 | Japan . | |
| 4-159405 | 6/1992 | Japan | 123/188.8 |
| 6-101429 | 4/1994 | Japan | 123/188.8 |
| 7-189628 | 7/1995 | Japan . | |

*Primary Examiner*—Erick R. Solis

*Attorney, Agent, or Firm*—Evenson, McKeown, Edwards & Lenahan, P.L.L.C.

[57] ABSTRACT

The invention is directed to a joined type valve seat which is joined into the cylinder head of an aluminum alloy in an internal combustion engine by resistance welding and, in particular, to an improved joined type valve seat superior in strength, rigidity, and abrasion resistance, whereby no cracks are caused when running the engine or when joining the valve seat to the engine block by resistance welding. The valve seat is made of a material having a tensile strength of 300 MPa or above, a radial crushing strength of 500 MPa or above, an elongation of 0.6% or more, a thermal conductivity of 15 W/(m·K) or above, a coefficient of thermal expansion of $10\times10^{-6}$ (1/K) or above, and an electric resistivity of 50 $\mu\Omega$·cm or below.

8 Claims, 2 Drawing Sheets

JOINED TYPE VALVE SEAT

FIELD OF THE INVENTION

The present invention relates to a valve seat used in an internal combustion engine, in particular a valve seat joined into or integral with the cylinder head of the engine.

This application claims the priority of Japanese Patent Application No. 145368/1996, filed Jun. 7, 1996, the disclosure of which is expressly incorporated by reference herein.

BACKGROUND OF THE INVENTION

In the commonly accepted technique, a valve seat was force-fitted into the cylinder head of an internal combustion engine and served to fulfill sealing of combustion gas as well as cooling of the valve. On the other hand, recently, in view of speed-up and weight reduction of cars, a multi-valve structure of the engine has been developed so that each cylinder has a plurality of intake and exhaust ports disposed close together. In this more recent design, in order to reduce the spaces between the valves, to ensure a degree of freedom in design such as enlarging the diameters of the intake and exhaust ports, to improve heat removal from the valve and the valve seat so as to relieve thermal load, and so forth, a joined type valve seat which is joined into the cylinder head has been proposed.

In the prior art, sintered alloys used for the valve seat have been known, for example, Japanese Patent Laid-Open No. 25959/1984 of which the entire disclosure is expressly incorporated herein by reference, which discloses a sintered alloy used for valve seats. This sintered alloy contains major amounts of C, Ni, Cr, Mo, Co, and also hard particles dispersed in the matrix structure, the hard particles being C-Cr-W-Co-Fe powder and Fe-Mo powder. Also, this sintered alloy includes continuous pores permeated with copper alloy, and has been used for valve seats superior in strength, rigidity and abrasion resistance.

But, where a joined type valve seat is made of such a conventional sintered alloy, cracks may occur in the valve seat when it is joined or when the engine is driven. Such cracks lower the sealing performance of the valve seat, and this leads to problems in mass production. The occurrence of cracks, compared with the force-fitted type of valve seat, is attributable to the relatively small form of the joined type valve seat, and is caused by exceeding its endurable stress limit when resistance welding for joining or when the engine is running.

To solve these problems, there is seen, for example, Japanese Patent Laid-Open No. 189628/1995 of which the entire disclosure is expressly incorporated herein by reference, which discloses a joined type valve seat which is made of a Cu-base alloy or an austenite-base iron series alloy, the valve seat being joined into the cylinder head by resistance welding.

Although there may be no cracks caused in this valve seat in the joining process or when the engine is running, it includes some expensive alloy elements, which brings economic disadvantage and also inferiority in strength, rigidity and abrasion resistance.

SUMMARY OF THE INVENTION

An object of the invention is to solve the above mentioned disadvantages and therefore to provide an improved valve seat superior in strength, rigidity and abrasion resistance which will not crack in the joining process or when the engine is running.

We hypothesized that the cracks which were caused by the resistance welding and by running of the engine, would occur from deformations created in the joining process and upon running of the engine, as well as by expansion and shrinkage due to heating and cooling of the running engine or when resistance welding.

We hypothesized that the cracks which were caused by resistance welding and by running of the engine, would occur from deformations caused in the joining process by resistance welding and in the knocking with the valve when running the engine, and from expansion and shrinkage due to heating and cooling when the engine is running or at the time of resistance welding. Thus we discovered that in order to prevent the joined type valve seat from developing cracks, material characteristics of the valve seat, particularly its strength, elongation, thermal conductivity, coefficient of thermal expansion and electric resistivity were important factors. All these characteristics had to exceed their limiting values so as to minimize the occurrence of cracks in the joined type valve seat. The present invention is based on the above mentioned knowledge and outcomes.

Accordingly, the present invention provides a joined type valve seat to be joined into an aluminum alloy cylinder head of an internal combustion engine by means of resistance welding, wherein the valve seat is made of a material having the following characteristics:

- a tensile strength of 300 MPa or above
- a radial crushing strength of 500 MPa or above
- an elongation of 0.6% or more
- a thermal conductivity of 15 W/(m·K) or above
- a coefficient of thermal expansion of $10\times10^{-6}$ (1/K) or above, and
- an electric resistivity of 50 $\mu\Omega\cdot$cm or below.

The material of the valve seat may be an iron-base sintered alloy, a copper-permeated iron-base sintered alloy or an iron-base sintered alloy with pores sealed with copper. Also, the material of the valve seat may be a nickel-base sintered alloy or a copper-base sintered alloy. Furthermore, the valve seat may be made of cast iron or cast steel or a copper-base alloy ingot material or a nickel-base alloy ingot material.

BRIEF DESCRIPTION OF THE DRAWINGS

Other objects, advantages and novel features of the present invention will become apparent from the following detailed description of the invention when considered in conjunction with the accompanying drawings, wherein.

DESCRIPTION OF THE PREFERRED EMBODIMENTS

Figure 1B:
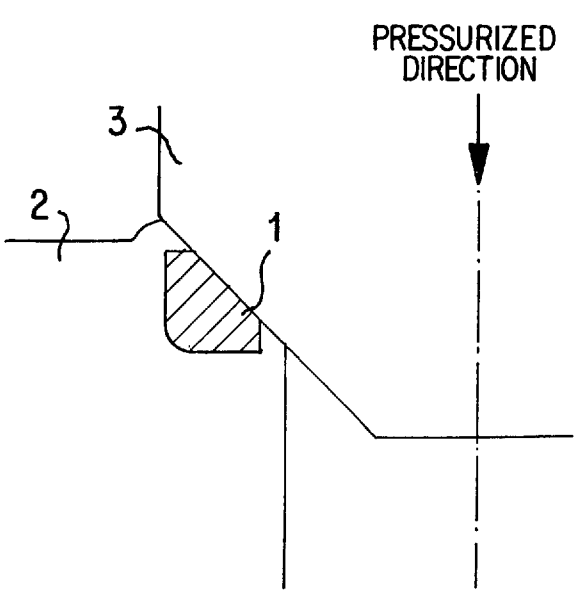
FIGS. 1*a* and 1*b* are schematic views showing a joining situation for joining the valve seat into the cylinder head by resistance welding.

The invention and advantageous details will now be explained more fully with reference to exemplary embodiments.

The joined type valve seat of the present invention is formed by working a material into a predetermined form and joining it to an aluminum alloy cylinder head by resistance welding. Although resistance welding is preferred, other methods such as friction welding or electronic beam welding could be used.

According to the present invention, a valve seat material used for the joined type valve seat has material characteristics of tensile strength of 300 MPa or above, a radial crushing strength of 500 MPa or above, an elongation of 0.6% or more, a thermal conductivity of 15 W/(m·K) or above, a coefficient of thermal expansion of $10\times10^{-6}$ (1/K) or above, and an electric resistivity of 50 $\mu\Omega$·cm or below.

We will now explain the reasons for the specified values of the material characteristics of a material used for our valve seat. The valve seat of the invention has a tensile strength of 300 MPa or above. If its tensile strength is lower than 300 MPa, it will not survive the joining force when resistance welding or against the force caused by knocking of the valve against the valve seat when the engine is running, and cracks in the valve seat may result. Therefore, the lower limit of its tensile strength will be 300 MPa.

The radial crushing strength of the valve seat is 500 MPa or above. If its radial crushing strength is lower than 500 MPa, it will not survive the joining force when resistance welding or against the force caused by knocking of the valve against the valve seat when the engine is running, and cracks in the valve seat may result. Therefore, the lower limit of its radial crushing strength will be 500 MPa.

The elongation of the valve seat is 0.6% or more. If its elongation is less than 0.6%, its expansion and contraction due to heating and cooling when resistance welding will not be within appropriate limits, and thus cracks may occur in the valve seat. Therefore, the lower limit of its elongation will be 0.6%.

The valve seat has a thermal conductivity of 15 W/(m·K) or above. If its thermal conductivity is lower than 15 W(m·K), thermal conduction of heat generated during resistance welding cannot be fully effected so that the heat required for joining cannot be transferred effectively to the joined surfaces, which results in trouble in the joining. Therefore, the lower limit of its thermal conductivity will be 15 W/(m·K).

The valve seat of the invention has a coefficient of thermal expansion of $10\times10^{-6}$ (1/K) or above. If its coefficient of thermal expansion is lower than $10\times10^{-6}$ (1/K), there is a fairly big difference in the coefficients of thermal expansion the valve seat and the aluminum alloy cylinder head into which the valve seat is joined, which leads to a big difference in expansion between the valve seat and the cylinder head when resistance welding or at heating and cooling when the engine is driven. This will cause cracks in the valve seat. Therefore, the lower limit of its coefficient of thermal expansion will be $10\times10^{-6}$ (1/K).

The valve seat has an electric resistivity of 50 $\mu\Omega$·cm or below. If its electric resistivity exceeds 50 $\mu\Omega$·cm, the electric conductivity is lowered and therefore the calorific value generated by the electric current when resistance welding will be less, so that the surfaces to be joined cannot be heated to an adequate temperature required for the joining. Therefore, its electric resistivity will be 50 $\mu\Omega$–31·cm or below.

For the valve seat of the invention, among known materials used for valve seats, materials which satisfy the above mentioned material characteristics could be usable. In particular, an iron-base sintered alloy, a copper-diffused iron-base sintered alloy and an iron-base sintered alloy with pores sealed with copper, are preferably used. Also, a nickel-base sintered alloy and a copper-base sintered alloy are preferable. Furthermore, cast iron, cast steel, copper-base alloy ingot and continuous casting material and nickel-base alloy ingot and continuous casting material may be used.

Any iron-base sintered alloy usable for the valve seat, among usually known iron-base sintered alloys, can be preferably used for the valve seat. In particular, iron-base sintered alloy is preferable which contains C, Ni, Cr, Co and Mo, and also contains hard particles consisting of C-Cr-W-Co-Fe particles and/or Fe-Mo particles dispersed in the matrix structure. Incidentally, Fe-base sintered alloy is preferable which is of the high speed steel series, stainless steel series, or low alloy series containing 0.5%–8% of at least one of nickel and molybdenum.

Further, copper-permeated iron-base sintered alloy can be obtained by the following process, namely powder the as raw material is filled into a metal mould and then press-formed by a forming press. After that, the formed powder body is sintered, and the sintered body together with copper alloy used for infiltration is heated to a temperature exceeding the melting point of the copper alloy to permeate pores with the copper alloy. Also, instead of such infiltration, copper powder will primarily be mixed into the raw material powder, and the copper powder can be liquefied at the sintering to permeate pores with copper.

In the present invention, sintered alloy is not always used, but an ingot and continuous casting material may be employed. As such ingot and continuous casting materials, cast iron or cast steel will be preferably usable. As preferable cast iron used for the valve seat, FCD600 spheroid graphite cast iron and flake graphite alloy cast iron containing chromium, boron and others are suitable. Otherwise, as preferable cast steel, there will be seen high nickel cast steel containing a considerable amount of nickel, high chromim cast steel and chromium-silicon series cast steel.

Also, the valve seat of the invention may be of nickel-base alloy or copper-base alloy. The nickel-base alloy will preferably be of NCF(JIS G4901-4902) series, nickel-chromium series and so forth. In the present invention, the valve seat will be of a copper-base alloy. Where the valve seat is made of copper-base alloy or nickel-base alloy, a metal powder sintering method, ingot and continuous casting material method or machining from rolled material will be employed.

The copper-base alloy usable for the valve seat of the invention is preferably of Cu-Ni-Si alloy, Cu-Be alloy and Cu-Cr alloy.

Embodiments of the materials for the joined type valve seat will now be described.

SAMPLE NO. 1

A primary powder (raw material) containing carbon powder, cobalt powder, nickel powder, C-Co-W-Cr-Fe alloy powder and atomized pure iron powder, was combined with zinc stearate and mixed together. This mixed powder was press-formed and thereafter sintered in a reducing atmosphere. Then the sintered body was permeated with copper and subjected to a heat treatment from which an iron-base sintered alloy was obtained. The composition of the obtained sintered alloy consisted of, by weight, C:1.3%, Ni:2.0%, Cr:6.5%, W:2.0%, Co:7.5%, Cu:13.0%, and the remainder being inevitable impurities and iron. This sintered alloy contained hard particles dispersed in the matrix structure. Such sintered alloy was worked to a joined type valve seat.

SAMPLE NO. 2

A primary powder containing carbon powder, cobalt powder, nickel powder, C-Co-W-Cr-Fe alloy powder and atomized pure iron powder, was combined with zinc stearate and mixed together. This mixed powder was press-formed and thereafter sintered in a reducing atmosphere, from which iron-base sintered alloy was obtained. The composition of the resultant sintered alloy was, by weight, C:1.3%, Ni:2.0%, Cr:6.5%, W:2.0%, Co:7.5% and the remainder being impurities and iron. The resultant sintered alloy contained hard particles dispersed in the matrix structure. The sintered alloy was worked to form a joined type valve seat.

SAMPLE NO. 3

A primary powder containing carbon powder, chromium-iron alloy powder, iron-molybdenum powder and pure iron powder, was combined with zinc stearate and mixed together. This mixed powder was press-formed and sintered in a reducing atmosphere, and subjected to a heat treatment, from which liquid-phase ironbase sintered alloy with chromium carbide precipitated in the matrix structure was obtained. The composition of the obtained sintered alloy was, by weight, C:2.0%, Cr:12.0% Mo:1.0%, the remainder being inevitable impurities and iron. This sintered alloy was worked to form a joined type valve seat.

SAMPLE NO. 4

A raw material which consisted of chromium metal, iron-tungsten metal, cobalt metal, nickel metal, recarburizer and steel, was melted in a high frequency melting furnace, and was cast to a nickel-base alloy which consisted of, by weight, C:2.5%, Cr:30%, W:15%, Co:10%, Ni:40%, and the balance iron. The thus obtained nickel-base alloy was subjected to a heat treatment to thereby obtain a material to be used for the valve seat.

SAMPLE NO. 5

A raw material which consisted of iron-chromium, nickel metal, recarburizer and steel, was melted in a high frequency melting furnace, to thereby obtain a nickel-base alloy ingot and continuous casting material which consisted of, by weight, C:1.0%, Cr:13%, Ni:45%, and the balance iron. This material was worked to form a joined type valve seat.

SAMPLE NO. 6

A spheroidal graphite cast iron (FCD 600) containing, by weight, C:3.6%, Si:2.0%, Mn:0.5%, Cu:1.0% and the balance iron, was obtained through a high frequency melting furnace-casting process. The obtained material was worked to form a joined type valve seat.

SAMPLE NO. 7

A flake graphite cast iron which consisted of, by weight, C:3.4%, Si:2.0%, Mn:0.7%, P:0.2%, B:0.05% and the remainder being inevitable impurities and iron and contained boron carbide precipitated in the matrix structure, was obtained through a high frequency melting furnace-casting process. The thus obtained material was worked to a joined type valve seat.

SAMPLE NO. 8

A copper-beryllium alloy ingot material was subjected to a heat treatment to thereby obtain a material used for the valve seat. This material was worked to a joined type valve seat.

SAMPLE NO. 9

A primary powder which consisted of carbon powder and high speed steel powder, was combined with zinc stearate and mixed together. This mixed powder was press-formed and then sintered in a reducing atmosphere. After that, the sintered body was permeated with copper to thereby obtain a copper permeated high speed steel series iron-base sintered alloy. The obtained sintered alloy had the composition consisting of, by weight, C:1.0%, Cr:2.0%, Mo:2.5%, W:3.0%, V:1.5%, Cu:15.0% and the remainder being inevitable impurities and iron, and contained fine carbide particles dispersed in the matrix structure. The obtained sintered alloy was worked to a joined type valve seat.

SAMPLE NO. 10

A ceramic which contained MgO powder, $Al_2O_3$ powder and $SiO_2$ powder, was mixed together with a sintering auxiliary agent and subjected to a powder press forming —sintering—heat treatment to thereby obtain a material used for the valve seat. This material was worked to a joined type valve seat.

SAMPLE NO. 11

A primary powder which consisted of carbon powder, nickel powder, molybdenum-inclusive atomized iron powder, copper powder and iron-molybdenum powder, was combined with zinc stearate and mixed together. This mixed powder was press-formed, sintered in a reducing atmosphere and subjected to a heat treatment, from which an iron-base sintered alloy was obtained. The obtained sintered alloy consisted of, by weight, C:1.1%, Cu:13.0%, Mo:10.0%, Ni:2.0% and the remainder being inevitable impurities and iron, and contained iron-molybdenum particles dispersed in the matrix structure. The obtained sintered alloy was worked to a joined type valve seat.

Figure 1A:
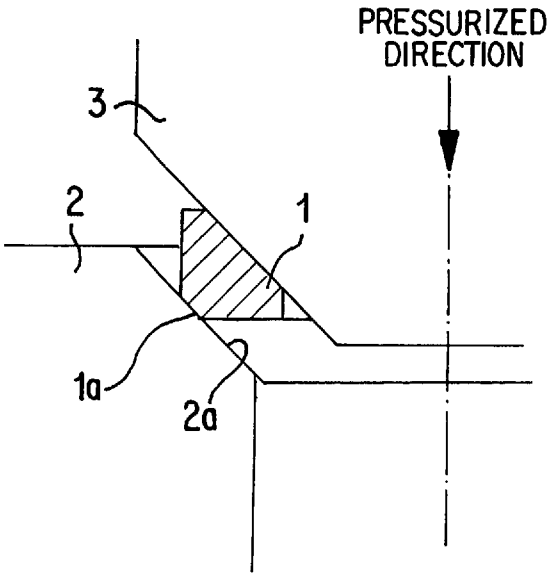
Figure 2:
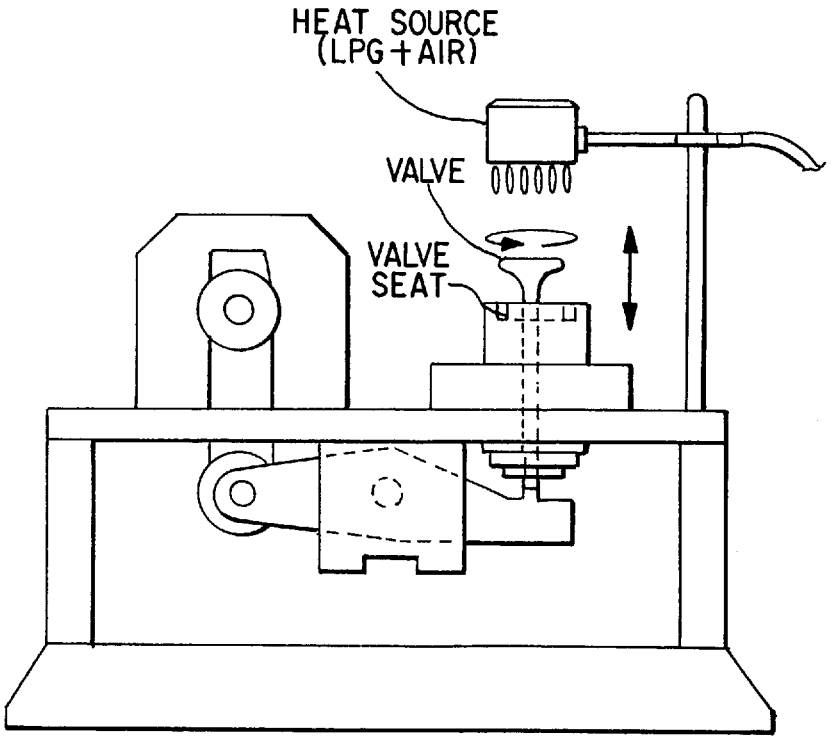
FIG. 2 is an approximate schematic view of a rig tester.

In the next step, the respective joined type valve seats were joined into a cylinder head made of an aluminum alloy (AC4C) by resistance welding. FIG. 1 shows the joining step by resistance welding.

As shown in Figure 1(*a*), the valve seat 1 is set in such a way that a projected portion 1*a* abuts on a slant surface 2*a* of the cylinder head 2, and pressure is applied in the direction of the arrow shown on valve seat 1. After that, an electric current is applied. After the contacting surfaces between the cylinder head 2 and the valve seat 1 and their proximity are heated to the melting point or a temperature close thereto, the electric current is cut off. Then the cylinder head 2 the hardness of which is lower than that of the valve seat is plastically deformed, and as shown in FIG. 1(*b*), the valve seat 1 is joined into the cylinder head 2 so as to be embedded therein.

After the joining process, any possible cracks in the valve seats were observed. The results are shown in Table 1.

The joined type valve seats which did not have cracks were tested in an endurance test by a rig tester under actual conditions of use, that is, at the same temperature and with valves, moving therein, in order to determine if cracks would form.

Figure 3:
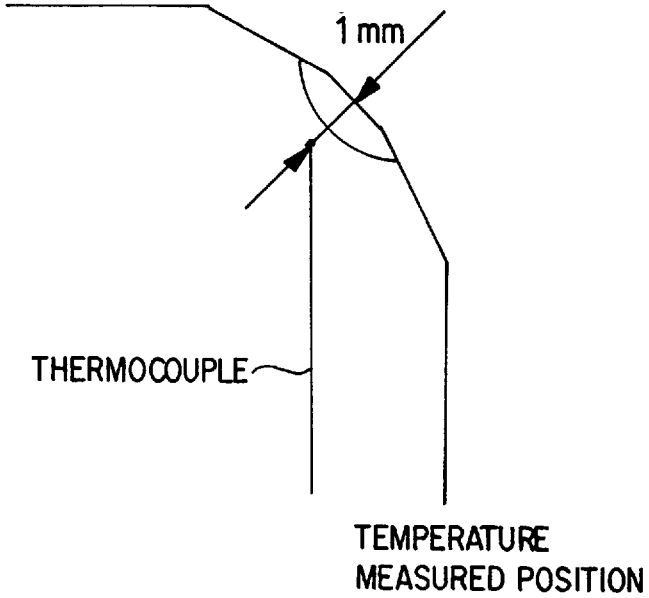
FIG. 3 is a schematic view showing a temperature-measured position of a sample in a rig tester.

The test conditions are as follows:

Test temperature: 400° C. (measured position: shown in FIG. 3)
Driving time: 30 hours
Cam rotary speed: 3000 rpm
Valve rotary speed: 10 rpm
Lift value: 7 mm
Load on seat: 89 kg
The results are shown in Table 1.

TABLE 1

| SAMPLE NO. | VALVE SEAT COMPOSITION | Tensile Strength MPa | Radial Crushing Strength MPa | Elong-ation % | Thermal Conductivity W/m-K | Coefficient of thermal expansion 1/K | Electric resistivity $\mu\Omega \cdot cm$ | OCCURRENCE OF CRACKS At joining by resistance welding | At rig test | REMARKS |
|---|---|---|---|---|---|---|---|---|---|---|
| 1 | C—Ni—Co—Cr—W—Cu series Fe-base sintered alloy (permeated with Cu) | 680 | 1300 | 1.3 | 40 | $13 \times 10^{-6}$ | 30 | Nil | Nil | Sample of invention |
| 2 | C—Ni—Co—Cr—W series Fe-base sintered alloy | 350 | 520 | 0.2 | 18 | $11 \times 10^{-6}$ | 41 | Yes | — | Compared sample |
| 3 | Liquid-phase sintered Fe-base sintered alloy | 550 | 1000 | 0.7 | 17 | $12 \times 10^{-6}$ | 43 | Nil | Nil | Sample of invention |
| 4 | Cu—Cr—W—Co—Fe series Ni-base alloy | 420 | 750 | 1.1 | 12 | $14 \times 10^{-6}$ | 80 | Not heated | — | Compared sample |
| 5 | Cu—Cr—Fe series Ni-base alloy | 480 | 830 | 1.0 | 16 | $13 \times 10^{-6}$ | 45 | Nil | Nil | Sample of invention |
| 6 | FCD-600 | 600 | 1050 | 3.0 | 37 | $12 \times 10^{-6}$ | 23 | Nil | Nil | Sample of invention |
| 7 | Boron carbide precipitated flake graphite cast iron | 280 | 410 | 0.3 | 34 | $12 \times 10^{-6}$ | 24 | Yes | — | Compared sample |
| 8 | Be—Cu alloy | 350 | 580 | 3.0 | 331 | $17 \times 10^{-6}$ | 7 | Nil | Nil | Sample of invention |
| 9 | High speed steel series sintered alloy (Cu-permeated) | 600 | 1100 | 1.0 | 41 | $13 \times 10^{-6}$ | 28 | Nil | Nil | Sample of invention |
| 10 | Ceramics ($2MgO.2Al_2O_3.5SiO_2$) | 380 | 580 | 0.1 | 8 | $2.5 \times 10^{6}$ | 123 | Not heated | — | Compared sample |
| 11 | C—Mo—Ni—Cu series Fe-base sintered alloy | 650 | 1050 | 1.1 | 38 | $13 \times 10^{-6}$ | 28 | Nil | Nil | Sample of invention |

In the range of the present invention, no cracks were caused by thermal stresses in the joining process, and in the rig tests under the same conditions as those in a real engine, no cracks were seen.

On the other hand, the joined type valve seats of compared samples No. 2 and No. 7 in which both the strength and the elongation are not in the range of the invention, cracks were caused at the time of joining by resistance welding.

In the joined type valve seat of compared sample No. 4 in which both the thermal conductivity and the electric resistivity are not in the range of the invention, and in the joined type valve seat of compared sample No. 10 in which the elongation, the thermal conductivity, the coefficient of thermal expansion, and electric resistivity are not in the range of the invention, joining could not be accomplished because of insufficiency of heating during resistance welding.

According to the present invention, there are not seen any cracks caused both at the time of joining by resistance welding and when the engine is running, whereby a high sealing performance can be maintained.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A joined type valve seat for being integrally joined with an aluminum alloy cylinder head of an internal combustion engine, said valve seat being made of a material having the following characteristics:

a tensile strength of 300 MPa or above a radial crushing strength of 500 MPa or above an elongation of 0.6% or more a thermal conductivity of 15 W/(m·K) or above a coefficient of thermal expansion of $10 \times 10^{-6}$ (1/K) or above, and an electric resistivity of 50 $\mu\Omega$·cm or below.

2. The joined type valve seat as set forth in claim 1, integrally joined to an aluminum alloy cylinder head by resistance welding.

3. The joined type valve seat as set forth in claim 1, formed of a material selected from the group consisting of an iron-base sintered alloy, a copper-permeated iron-base sintered alloy, and an iron-base sintered alloy with pores sealed by copper.

4. The joined type valve seat as set forth in claim 3, integrally joined to an aluminum alloy cylinder head by resistance welding.

5. The joined type valve seat as set forth in claim 1, formed of a nickel-base sintered alloy or a copper-base sintered alloy.

6. The joined type valve seat as set forth in claim 5, integrally joined to an aluminum alloy cylinder head by resistance welding.

7. The joined type valve seat as set forth in claim 3, wherein said valve seat is made of cast iron, cast steel, a copper-base alloy ingot and continuous casting material, or a nickel-base alloy ingot and continuous casting material.

8. The joined type valve seat as set forth in claim 7, integrally joined to an aluminum alloy cylinder head by resistance welding.

* * * * *